US006955423B2

(12) United States Patent
Rodriquez Mojica et al.

(10) Patent No.: US 6,955,423 B2
(45) Date of Patent: Oct. 18, 2005

(54) INKJET CARTRIDGE WITH AIR MANAGEMENT SYSTEM

(75) Inventors: Julio A. Rodriquez Mojica, San Juan, PR (US); William F. King, Eagle, ID (US); Ivan Baiges, Mayaguez, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 600 days.

(21) Appl. No.: 10/356,774

(22) Filed: Jan. 31, 2002

(65) Prior Publication Data

US 2003/0142183 A1 Jul. 31, 2003

(51) Int. Cl.[7] ..... B41J 2/275
(52) U.S. Cl. ..... 347/86; 347/87
(58) Field of Search ..... 347/85, 86, 87

(56) References Cited

U.S. PATENT DOCUMENTS 5,182,581 A * 1/1993 Kashimura et al. ..... 347/87
6,247,807 B1 * 6/2001 Yang et al. ..... 347/87
6,490,792 B1 * 12/2002 Ishinaga et al. ..... 29/890.1

* cited by examiner

*Primary Examiner*—Anh T. N. Vo

(57) ABSTRACT

An inkjet cartridge for use with a thermal inkjet printer includes a standpipe area and an entrained ink chamber that are connected in fluidic communication. The entrained ink chamber and standpipe area can be enclosed by a wall that can have a plurality of panels or facets. The inkjet cartridge also includes a duct or passage that is connected in fluidic communication to both the standpipe area and the entrained ink chamber, wherein the connection to the entrained ink chamber is operatively located above the standpipe area, thus enabling anomalous air bubbles to migrate from the standpipe area and into the entrained ink chamber.

9 Claims, 3 Drawing Sheets

INKJET CARTRIDGE WITH AIR MANAGEMENT SYSTEM

FIELD OF THE INVENTION

The invention claimed and disclosed herein pertains to thermal inkjet printers, and more specifically, to ink cartridges employed in conjunction therewith.

BACKGROUND OF THE INVENTION

Imaging apparatus include devices that are configured to selectively produce specific, predefined images on one or more types of imaging media such as paper. Examples of images produces by imaging apparatus include letters and other documents, as well as graphical images such as photographs and the like. Among the various types of imaging apparatus that are presently available, the type generally known as the "inkjet printer" is one of the more popular. Although the general operation and function of inkjet printers is well known in the art, a brief overview is provided herein.

The operation of a typical inkjet printer involves advancing, or moving, a sheet of paper (or other imaging media) vertically (typically) relative to a print nozzle from which tiny droplets of ink are precisely and accurately projected, or "fired," onto the paper in order to produce the desired image. The print nozzle is also typically independently movable in transverse relation to the direction of advancement of the imaging media. Thus, the advancement of the paper, along with the transverse movement relative thereto of the print nozzle, effectively provides the print nozzle with a two-dimensional range of movement relative to the sheet of paper upon which the image is to be printed.

Typical inkjet printers include one or more ink cartridges which include a nozzle. Each ink cartridge has at least one reservoir chamber in which ink is stored for use. The reservoir chamber is generally defined by a multifaceted, enclosed wall that is usually fabricated from rigid plastic or the like. The print nozzle, or nozzle assembly, which is mentioned above, is usually supported on the exterior of the wall which defines the reservoir chamber. Ink from the reservoir chamber is directly supplied to the nozzle assembly through an opening in the wall.

The nozzle assembly generally defines one or more capillary passages into which ink from the chamber is allowed to flow. More specifically, each capillary passage has two opposite termini, wherein one of the termini is fluidly communicable with the reservoir chamber and the other termini is precisely oriented so as to be directed or aimed at the imaging media.

In many applications the nozzle assembly generally also includes a selectively controlled heater associated with each capillary passage. Each heater is typically in the form of an electrical resistor, or the like, that is capable of a nearly instantaneous and substantial increase in temperature. The heater is selectively activated, or heated, on command, thereby vaporizing a portion of the ink within the associated capillary passage. The vaporization of the ink within the capillary passage causes a droplet of ink to be projected, or "fired," out of the capillary passage and toward the sheet of paper. The vapor quickly condenses and/or escapes from the capillary passage, whereupon additional ink is drawn into the capillary passage from the reservoir chamber by way of capillary attraction.

A well-known practice within the art is to employ a type of foam material within the reservoir chamber to control the flow of ink out of the chamber and to control the flow of air into the chamber. For example, it is known that such employment of foam material can prevent the unintended leakage, or "drooling," of ink out of the nozzle. A common type of foam material thus employed is that of open cell urethane foam. The cells of the foam material are usually of a size that will cause ink to be drawn into the foam material by way of capillary attraction.

Thus, a typical inkjet cartridge contains a given quantity of foam material in which a given volume of ink can be "entrained," or absorbed by way of capillary attraction. Generally, the foam material is located substantially adjacent to the nozzle assembly so that ink is drawn directly to the nozzle assembly from the foam, although in most cases, a small open chamber called a "standpipe area" is employed between the foam and the nozzle assembly. Thus, typically, the ink is drawn into the standpipe area from the foam and then is drawn from the standpipe area in to the nozzle assembly for firing.

Generally, two different types of ink cartridge reservoir chamber configurations are known—the one-chamber type and the two-chamber type. In the one-chamber type, the ink cartridge includes a single reservoir chamber that is substantially filled with foam in which ink can be entrained. In such a one-chamber configuration, substantially the entire quantity of ink available for printing is entrained within the foam material. As ink is consumed as the result of the printing process, the ink is simply drawn into the standpipe area and then into the nozzle assembly from the foam. Some types of one-chamber ink cartridges are refillable by way of injection of a replenishment ink supply into the foam.

In the two-chamber type of ink cartridge reservoir configuration, the ink cartridge has both an entrained ink chamber containing foam material, and a free ink chamber that is devoid of foam. The two chambers are generally separated from one another by a dividing barrier that has a hole ("ink port") to allow ink and/or air to flow between the two chambers. Initially, both the entrained ink chamber and the free ink chamber are filled with ink. Some types of two-chamber ink cartridges are refillable by replenishing the free ink chamber with ink and injecting replenishment ink into the foam of the entrained ink chamber.

In operation of such a two-chamber type of cartridge, the ink is drawn from the foam material, as in the one-chamber type. However, as the ink is drawn from the foam material it is replenished by ink from the free ink chamber, which ink flows through the ink port defined in the dividing barrier wall. Typically, as the level of ink in the free ink chamber falls, air is allowed to migrate into the free ink chamber through a vent aperture. The vent aperture is generally located adjacent to the entrained ink chamber so that the air flows through the entrained ink chamber on its way to the free ink chamber.

As mentioned above, typical inkjet cartridges employ a standpipe area immediately adjacent to the nozzle assembly. The standpipe area is generally a relatively small open area devoid of foam and located between the foam material and the nozzle assembly. Ideally, the standpipe area remains filled with ink at all times. This quantity of free-flowing ink in the standpipe area generally facilitates the function of the nozzle assembly by allowing the capillaries of the nozzle assembly to quickly refill with ink.

However, it is known that small amounts of air in the form of bubbles can become entrapped within the standpipe area over time. Such air bubbles can become entrapped in the standpipe area due to normal operation of the ink cartridge and as the result of refilling of the ink cartridge with replenishment ink. Air bubbles that become entrapped within the standpipe area can have deleterious effects on the operation of the nozzle assembly and thus, on print quality.

What is needed then, is an inkjet cartridge that achieves the benefits to be derived from similar prior art devices, but which avoids the shortcomings and detriments individually associated therewith.

SUMMARY OF THE INVENTION

The inkjet cartridge in accordance with one embodiment of the present invention generally includes an entrained ink chamber and a standpipe area which are both substantially enclosed by a wall that can have multiple panels or facets. The inkjet cartridge also includes a duct or passage that is connected in fluidic communication with both the standpipe area and the entrained ink chamber. The duct can enable gas that has become entrapped, or which has otherwise formed, within the standpipe area to be vented or conveyed out of the standpipe area, thus increasing the performance quality of the inkjet cartridge.

The inkjet cartridge can also include other features such as a free ink chamber that is separated from the entrained ink chamber by a divider panel. Additionally, the duct can be at least partially defined within the divider panel so as to be located substantially between the entrained ink chamber and the free ink chamber. A channel and an ink port can be defined on and through the divider panel, respectively, wherein the channel preferably intersects both the ink port and the outlet opening of the duct.

DETAILED DESCRIPTION OF THE INVENTION

In accordance with at least one embodiment of the present invention, an inkjet cartridge includes an entrained ink chamber and a standpipe area that are operatively connected with one another in fluidic communication. The inkjet cartridge also includes a duct or passage that has an inlet opening and a distal outlet opening, wherein the inlet opening is connected in fluidic communication with the standpipe area, and wherein the outlet opening is connected in fluidic communication with the entrained ink chamber. The outlet opening can be operatively located above the standpipe area.

Figure 1:
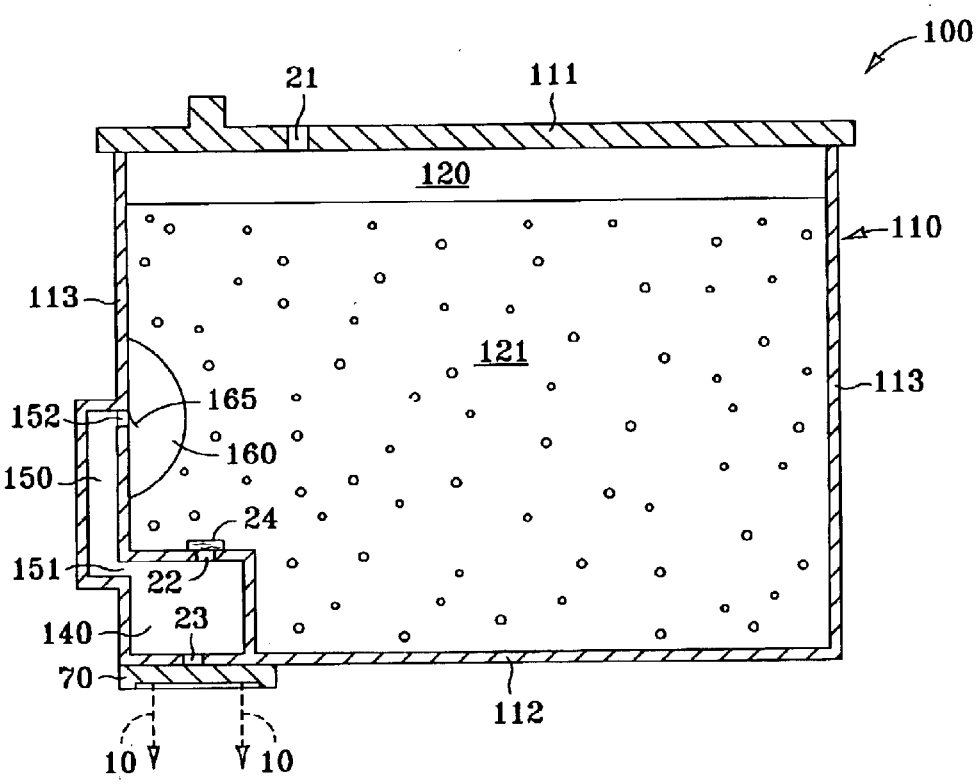
FIG. 1 is a sectional elevation view of an inkjet cartridge in accordance with one embodiment of the present invention.

With reference to FIG. 1, a sectional elevation view is shown in which is depicted an inkjet cartridge 100 in accordance with one embodiment of the present invention. The inkjet cartridge 100 includes an entrained ink chamber 120 and a standpipe area 140. The entrained ink chamber 120 and the standpipe area 140 can be enclosed by a wall 110, as is shown so as to each contain a quantity of ink (not shown).

The entrained ink chamber 120 can contain a capillary reticulate material 121 in which a quantity of ink can be entrained, or absorbed by way of capillary attraction. That is, the term "capillary reticulate material" as used herein denotes a material in which is defined a network of capillary openings and/or passages so as to function to absorb or entrain therein, a quantity of ink. The capillary reticulate material 121 can typically be a foam material such as urethane foam, or the like. However, it is understood that any type of material, in addition to foam, can be employed as the capillary reticulate material 121. The capillary reticulate material 121 can substantially fill the entrained ink chamber 120 as is shown.

The wall 110 can have any of a number of possible shapes and can include any number of facets or panels and the like. For example, the wall 110 can include a top panel 111, a bottom panel 112, and a plurality of side panels 113 which are connected so as to substantially enclose the entrained ink chamber 120 and the like as is depicted. More specifically, the top panel 111 can be substantially flat as is shown, and can define therethrough a vent opening or aperture 21.

Similarly, the bottom panel 112 can be substantially flat and spaced-apart from the top panel 111 in parallel, juxtaposed relation thereto as shown. Also, as is seen, the standpipe area 140 can be located substantially adjacent to the bottom panel 112. An inkjet nozzle assembly 70 can be included and can be supported on the bottom panel 112 proximate the standpipe area 140 as is depicted.

The wall 110 can also include a plurality of substantially flat, spaced-apart side panels 113 which can be oriented in substantially parallel, juxtaposed relation to one another. The side panels 113 can also extend between, and can be oriented substantially normal to, the top panel 111 and the bottom panel 112. Thus, as can be seen, the entrained ink chamber 120 can be substantially enclosed by the top panel 111, the bottom panel 112, and the side panels 113.

The entrained ink chamber 120 and the standpipe area 140 are connected in fluidic communication. That is, the entrained ink chamber 120 and the standpipe area 140 are connected in a manner whereby fluidic flow is enabled therebetween. For example, a standpipe opening 22 can be defined through the wall 110 as shown to enable ink to flow from the entrained ink chamber 120 and into the standpipe area 140. It is noted that the entrained ink chamber 120 and the standpipe area 140 need not be separated in any portion or manner by a wall or dividing member. In other words, the delineation between the standpipe area 140 and the entrained ink chamber 120 can be, for example, the edge of the capillary reticulate material 121.

However, in a configuration in accordance with which a wall or other object separates the standpipe area and the entrained ink chamber 120, the standpipe opening 22 is provided so as to define a passage between the entrained ink chamber 120 and the standpipe area 140 generally in the manner depicted. Also, a filter 24 can also be included in the inkjet cartridge 100. The filter 24 can be operatively disposed between the entrained ink chamber 120 and the standpipe area 140 as shown. That is, the inkjet cartridge 100 can include a filter 24 in addition to the standpipe opening 22, wherein the filter is oriented relative thereto, and whereby any fluid that passes through the standpipe opening also passes through the filter.

Filters such as the filter 24 are known in the art and can include one of a number of types such as photo-etched metal sheet, membrane, and composite. Additionally, the filter 24 can be oriented relative to the standpipe opening 22 in one of several possible manners. For example, the filter 24 can be oriented relative to the standpipe opening 22 as depicted, wherein the filter is in adjacent, juxtaposed relation to the standpipe opening. As a further example which is not specifically depicted, the filter 24 can be located substantially within the standpipe opening 22. Other known orientations not specifically depicted herein of the filter 24 relative to the standpipe opening 22 are possible.

In any case, the filter 24 can define therethrough a plurality of capillary openings so as to facilitate control of various fluids which may be present within the standpipe area 140 and/or the entrained ink chamber 120. That is, the filter 24 can be configured to allow the passage therethrough of ink or other such liquid, while preventing the passage therethrough of air or other gases. Furthermore, the capillary reticulate material 121 and the filter 24 can be in contact with one another as depicted. That is, no substantial gap need exist between the capillary reticulate material 121 and the filter 24.

Still referring to FIG. 1, the nozzle assembly 70 and the standpipe area 140 can be connected to one another in fluidic communication, whereby fluidic flow is enabled therebetween. That is, for example, a discharge opening 23 can be defined through the wall 110 to enable ink to flow from the standpipe area 140 and into the nozzle assembly 70. The nozzle assembly 70 can be configured to selectively project ink droplets generally in the direction indicated by the arrows marked 10.

Further reference to FIG. 1 reveals that the inkjet cartridge 100 includes a duct or passage 150 that is connected in fluidic communication between the entrained ink chamber 120 and the standpipe area 140. That is, the inkjet cartridge 100 has a duct 150 that has an inlet opening 151 and an opposite, distal outlet opening 152, wherein the inlet opening is connected in fluidic communication with the standpipe area 140, while the outlet opening is connected in fluidic communication with the entrained ink chamber 120. In other words, the duct 150 is configured to convey fluid, such as ink, between the standpipe area 140 and the entrained ink chamber 120.

The outlet opening 152 of the duct 150 is operatively located above the standpipe area 140. That is, when the inkjet cartridge 100 is in an operative position, the outlet opening 152 is located above the standpipe area 140. The duct 150 can be elongated, whereby the outlet opening 152 is operatively located significantly above the standpipe area 140 as is shown. As is also seen, the duct 150 can be defined within the wall 110, and can be defined within one of the side panels 113. However, it is noted that the duct 150 can alternatively be defined within a tube (not shown) that is not part of the wall 110. The duct 150 can also be substantially vertically oriented, as well as being oriented in substantially parallel orientation to the side panels 113.

As is further seen from a study of FIG. 1, a void 160, or open area, can be located adjacent to the outlet opening 152 of the duct 150. The void 160 can be defined between the capillary reticulate material 121 and the wall 110 as shown. That is, the wall 110 and the capillary reticulate material 121 can serve to enclose and define the void 160, whereby the outlet opening 152 is substantially surrounded by the void as shown. As is seen from an examination of FIG. 1, the void 160 can be substantially defined within the capillary reticulate material 121 while being bordered by the wall 110.

The inkjet cartridge 100 can include a valve 165 that is operatively connected with the duct 150, whereby the valve is configured to control fluidic flow through the duct. As is depicted, the valve 165 can be supported on the wall 110 and more specifically, the valve can be supported on one of the side panels 113 so as to be operatively located at the outlet opening 152 of the duct 150. Also, the valve 165 can be a one-way valve, whereby fluidic flow is allowed only from the duct 150 and into the entrained ink chamber 120. That is, the valve 165 can be, for example, a one-way valve, such as a check valve, that allows fluid to flow in one direction only—from the standpipe area 140 to the entrained ink chamber 140.

Figure 2:
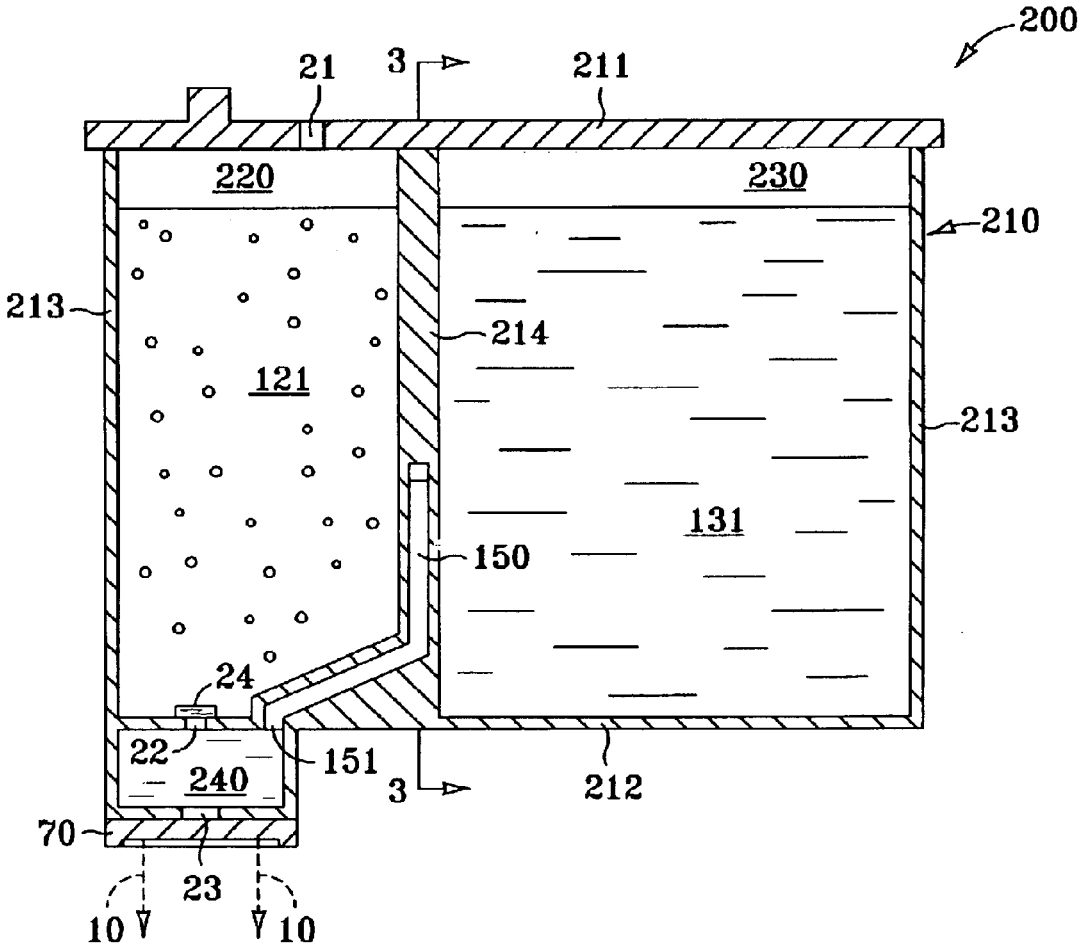
FIG. 2 is a sectional elevation view of an inkjet cartridge in accordance with another embodiment of the present invention.

Turning now to FIG. 2, another sectional elevation view is shown in which an inkjet cartridge 200 is depicted in accordance with another embodiment of the present invention. The inkjet cartridge 200 includes an entrained ink chamber 220, a standpipe area 240, and a free ink chamber 230. The free ink chamber 230 and the entrained ink chamber 220 can be located substantially adjacent to one another as depicted. That is, the free ink chamber 230 can be proximate and in lateral, juxtaposed relation to the entrained ink chamber 220.

The entrained ink chamber 220, the free ink chamber 230, and the standpipe area 240 can be enclosed by the wall 210 which can be substantially similar to the wall 110 that is described in detail above with respect to the inkjet cartridge 100 which is depicted in FIG. 1. Still referring to FIG. 2, the wall 210 can include a substantially flat top panel 211 and a substantially flat bottom panel 212. The bottom panel 212 can be spaced-apart from, and oriented in substantially parallel, juxtaposed relation to, the top panel 211, as is also described above with respect to the top and bottom panels of the inkjet cartridge 100. A vent opening or aperture 21 can be defined through the top panel 211. As is described above with respect to the inkjet cartridge 100, the standpipe area 240 of the inkjet cartridge 200 can be adjacent to the bottom panel 212 as is seen in FIG. 2.

The wall 210 can also include a plurality of substantially flat side panels 213, wherein the side panels can be spaced-apart from one another as shown. The side panels 213 can also be oriented in substantially parallel, juxtaposed relation to one another, as is depicted. The side panels 213 can also extend between, and can be substantially normal to, the top panel 211 and the bottom panel 212. As is seen from an examination of FIG. 2, the entrained ink chamber 220, as well as the free ink chamber 230, and the standpipe area 240, can be substantially enclosed by the top panel 211, the bottom panel 212, and the side panels 213.

The inkjet cartridge 200 also has a divider panel 214 that extends between the top panel 211 and the bottom panel 212 as shown. The divider panel 214 serves to substantially separate the entrained ink chamber 220 from the free ink chamber 230. The divider panel 214 can be substantially normal to both the top panel 211 and the bottom panel 212.

As is further seen, the entrained ink chamber 220 can contain a capillary reticulate material 121 that can substantially fill the entrained ink chamber. The capillary reticulate material 121 is capable of absorbing a quantity of ink (not shown) by way of capillary attraction as is explained above with respect to the ink cartridge 100. As is shown in FIG. 2, the free ink chamber 230 of the ink cartridge 200 is capable of containing a quantity of liquid 131 such as ink.

Still referring to FIG. 2, the standpipe area 240 is connected in fluid communication with the entrained ink chamber 220 as is described above with respect to the inkjet cartridge 100. That is, a passage, such as the standpipe opening 22, can enable fluid such as ink or the like to flow from the entrained ink chamber 220 and into the standpipe area 240. The ink cartridge 200 can also include a filter 24 that is operatively disposed between the entrained ink chamber 220 and the standpipe area 240 as depicted. The filter 24 is described above with respect to the inkjet cartridge 100.

As is also described above with respect to the inkjet cartridge 100, a nozzle assembly 70 can be operatively supported on the wall 210 of the inkjet cartridge 200, whereby ink droplets can be selectively projected from the nozzle assembly in the general direction indicated by the arrows marked 10. The nozzle assembly 70 can be connected in fluidic communication to the standpipe area 240. Such fluidic communication between the nozzle assembly 70 and the standpipe area 240 can be by way of the discharge opening 23 or the like.

With continued reference to FIG. 2, the inkjet cartridge 200 includes a duct 150. The duct 150 has an inlet opening 151 and an opposite, distal outlet opening which is not shown in FIG. 2, but which is shown in additional figures and discussed in detail below. The inlet opening of the duct 150 is connected in fluidic communication with the standpipe area 240. As is further seen with reference to FIG. 2, the duct 150 can be located substantially between the entrained ink chamber 220 and the free ink chamber 230. That is, at least a portion of the duct 150 can be located adjacent to, and between, the entrained ink chamber 220 and the free ink chamber 230. More specifically, the duct 150 can be defined within the divider panel 214 as shown.

Figure 3:
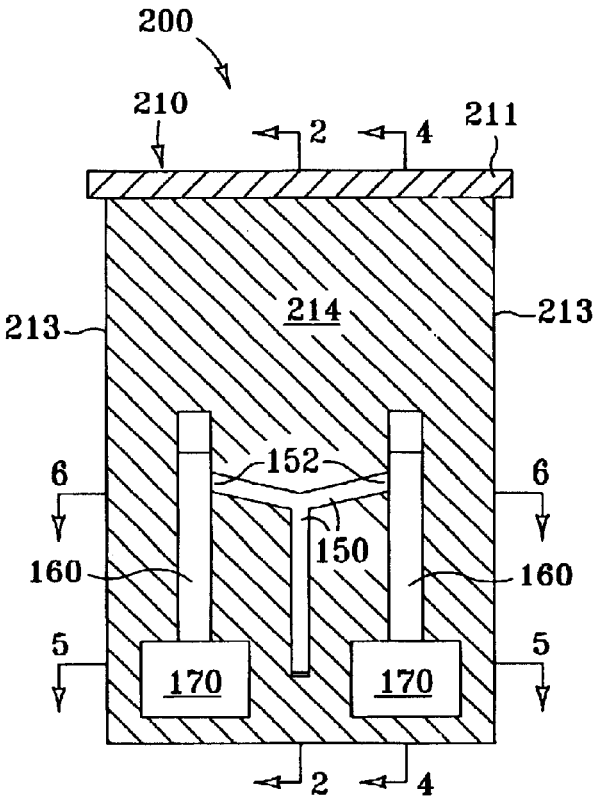
FIG. 3 is another sectional elevation view of the inkjet cartridge depicted in FIG. 2.

Turning now to FIG. 3, a sectional elevation view of the inkjet cartridge 200 is shown, wherein the section is taken through the divider panel 214. As is seen, the duct 150 can be defined within the divider panel 214. As is also seen, the duct 150 has an outlet opening 152 that is not shown in the previously discussed figure (FIG. 2). That is, due to the shape of the duct 150, the inlet opening 151 and the outlet opening 152 are not visible in the same view. As is illustrated, the duct 150 need not be continuously straight. That is, the duct 150, as is illustrated with respect to the description of the inkjet cartridge 200, can have one or more turns or legs which are oriented in different directions.

With reference now to both FIGS. 2 and 3, it is seen that the duct 150 can be elongated, wherein the inlet opening 151 is distal from the opposite outlet opening 152. It is also seen that the outlet opening 152 can be operatively located above the standpipe area 240. The duct 150 can have more than one outlet opening 152. For example, as depicted in FIG. 3, the duct 150 can be substantially "T-shaped" so as to have two outlet openings.

Similarly, the duct 150 can have a plurality of inlet openings 151, although only one inlet opening is depicted in FIG. 2. The duct 150 can be configured in a manner in which no part of the duct is horizontal. That is, although the duct 150 can have several different legs which are oriented in different directions, wherein each leg or portion of the duct is either inclined or vertical so that the duct as a whole leads continuously upward from the inlet opening 151 to the outlet opening. In this manner, air bubbles can be less likely to become entrapped or "stuck" within the duct 150.

Referring to both FIGS. 2 and 3, at least one open channel 160, or groove, can be defined on the wall 210. Such a channel 160 can be defined on the divider panel 214 as shown. As depicted, two channels 160 can be defined on the divider panel 214. It is also seen that at least one ink port 170 can be defined through the divider panel 214. However, two ink ports 170 are depicted, as is evident from an examination of FIG. 3. The ink port 170 can be located substantially adjacent to the bottom panel 212. Preferably, at least one channel 160 is associated with each ink port 170 as shown.

Figure 4:
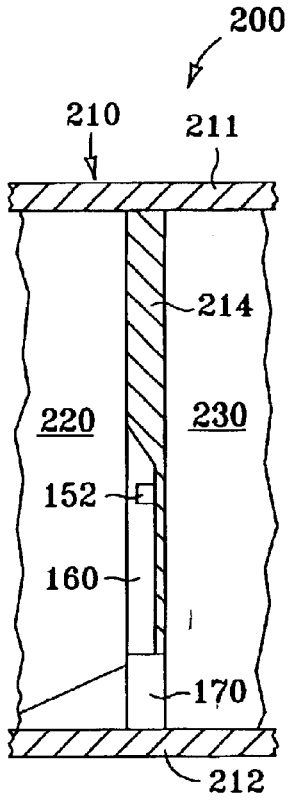
FIG. 4 is another sectional elevation view of the inkjet cartridge depicted in FIG. 2.

Moving now to FIG. 4, another sectional elevation view is shown. From an examination of FIG. 4, it is seen that the channel 160 can be exposed to the entrained ink chamber 220. That is, the channel 160 can be located within the entrained ink chamber 220. Also evident from a study of FIG. 4, the ink port 170 can be defined through the divider panel 214. In this manner, the entrained ink chamber 220 and the free ink chamber 230 can be connected in fluidic communication with one another by way of the ink port 170. It is noted that the capillary reticulate material 121 is omitted from FIG. 4, as well as from succeeding figures, for clarity. Likewise, the liquid 131 is omitted from FIG. 4, as well as succeeding figures.

With reference now to both FIGS. 3 and 4, the outlet opening 152 of the duct 150 can be operatively located above the ink port 170. Also, the channel 160 can intersect both the ink port 170 and the outlet opening 152. That is, the outlet opening 152 can join the channel 160 above the ink port 170, as is depicted. Similarly, the channel 160 can also join the ink port 170. The channel 160 can be substantially vertical and can also extend substantially upward from the ink port 170.

Figure 5:
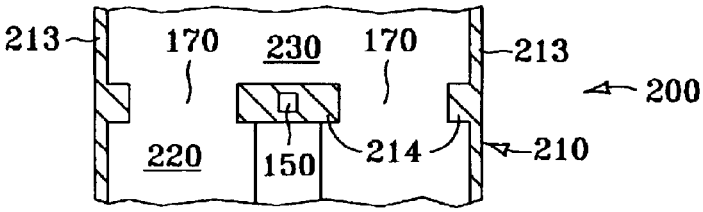
FIG. 5 is a sectional plan view of the inkjet cartridge depicted in FIG. 2.
Figure 6:
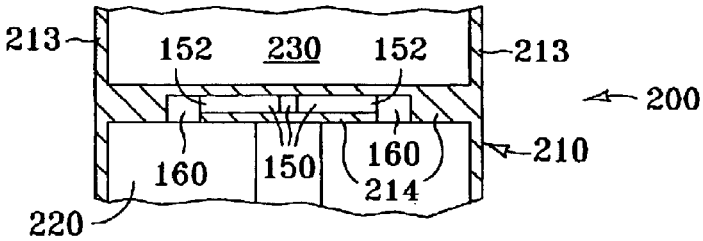
FIG. 6 is another sectional plan view of the inkjet cartridge depicted in FIG. 2.

Turning now to FIGS. 5 and 6, two sectional plan views of the inkjet cartridge 200 are shown. More specifically, FIGS. 5 and 6 depict a lower section and an upper section, respectively, which are in juxtaposed relation to one another with respect to the inkjet cartridge 200. That is, FIG. 5 depicts a section that is taken immediately below the section depicted in FIG. 6. As is seen from an examination of FIG. 5, the duct 150 can pass substantially vertically through the divider panel 214 and past and/or between the one or more ink ports 170.

With reference now to FIGS. 5 and 6, it is seen that the channel 160 as well as the outlet opening 152 of the duct 150 can be located above the ink port 170. It is also seen that the outlet opening 152 can be located within the channel 160, wherein the channel can be located substantially within the entrained ink chamber 220 as shown.

With reference to FIGS. 2 and 4, although the capillary reticulate material 121 is omitted from FIG. 4 as noted above, it is seen that the capillary reticulate material, when in position within the entrained ink chamber 220, can cover the ink port 170, and can also cover the channel 160 and the outlet opening 152. That is, inasmuch as the capillary reticulate material 151 can substantially fill the entrained ink chamber 150, as is depicted in FIG. 2, it is clear from an examination of FIG. 4 that the capillary reticulate material can also substantially cover the channel 160 and the ink port 170.

Turning back briefly to FIG. 1, during operation of the inkjet cartridge 100, small air bubbles (not shown) can become entrapped, or can otherwise form, within the standpipe area 240 as is discussed above with respect to the prior art. However, by employing the duct 150 of the present invention, such air bubbles that may accumulate within the standpipe area 240 can be advantageously conveyed, or vented, from the standpipe area and into the entrained ink chamber 220 by way of the duct.

Likewise, with reference to FIGS. 2 through 6, during operation of the inkjet cartridge 200, small air bubbles can similarly become entrapped, or otherwise form, within the standpipe area 240 as discussed above. However, by employing the duct 150 of the present invention, such air bubbles can be conveyed, or vented, by way of the duct from the standpipe area and into the entrained ink chamber 220.

The location of the outlet opening 152 of the duct 150 within the channel 160 can facilitate movement of air bubbles within the duct by advantageously employing the pressure differential experienced by the channel as the result of the pressure equalization cycle that is described above with respect to the prior art, wherein air travels into the vent opening 21, down through the channel 160, through the ink port 170, and into the free ink chamber 230.

It can be appreciated that the present invention, in accordance with various embodiments thereof such as is exemplified by the cartridges 100 and 200 which are described above in detail and which are depicted in the accompanying figures, can be particularly useful in situations wherein the respective cartridge is configured to be repeatedly refilled with ink upon depletion thereof through use. In such situations, air bubbles can tend to accumulate over time and become entrapped within the cartridge so as to cause malfunctioning thereof. However, it is understood that the application of the present invention is not intended to be limited to any particular type of cartridge and thus the invention is intended to be equally applicable to one-time-use cartridges as well as refillable cartridges.

In accordance with another embodiment of the present invention, a method of operating an inkjet cartridge includes providing an inkjet cartridge having an entrained ink chamber and a standpipe area. The method also includes venting gas bubbles from the standpipe area into the entrained ink chamber. That is, the inkjet cartridge provided in accordance with such a method can be configured, by way of example only, in the manner of either the inkjet cartridge 100 or the inkjet cartridge 200, both of which are discussed in detail above and shown in the accompanying figures.

More specifically, the inkjet cartridge provided in accordance with the method can include a duct or passage that leads from the standpipe area to the entrained ink chamber and which is configured to convey or vent gas bubbles from the standpipe area to the entrained ink chamber. That is, in accordance with the method, a passage can be provided between the standpipe area and the entrained ink chamber, through which passage gas bubbles can pass from the standpipe area to the entrained ink chamber.

However, it is understood that other configurations of inkjet cartridges not specifically shown or described herein can be employed in accordance with the method. In other words, in accordance with the method, entrapped anomalous gas bubbles which may become entrapped in the standpipe area can be vented or conveyed out of the standpipe area and into the entrained ink chamber by way of any means and/or inkjet cartridge configuration which will operate to function in the manner described in accordance with the method.

Also in accordance with the method, fluid flow through the passage or duct can be controlled. For example, a valve such as the valve describe above with respect to the inkjet cartridges 100 and 200 can be employed to control the flow of fluid through a duct or passage that leads from the standpipe area to the entrained ink chamber. More specifically, for example, a one-way valve can be provided so as to allow fluid to flow only one way through the passage or duct. That is, in accordance with the method, controlling the flow of fluid through the passage or duct can include allowing fluid to flow only one way from the standpipe area to the entrained ink chamber.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An inkjet cartridge including an entrained ink chamber and a standpipe area that are connected in fluidic communication, the inkjet cartridge comprising:

a duct that has an outlet opening and an opposite distal inlet opening, wherein the outlet opening is connected in fluidic communication with the entrained ink chamber, and wherein the outlet opening is operatively located above the standpipe area, and wherein the inlet opening is connected in fluidic communication with the standpipe area;

a capillary reticulate material operatively disposed within the entrained ink chamber, wherein a void is defined in the capillary reticulate material substantially adjacent to the outlet opening of the duct; and, a one-way valve operatively disposed at the outlet opening of the duct, whereby fluidic flow is allowed only from the duct to the entrained ink chamber.

2. An inkjet cartridge comprising:

a wall that encloses an entrained ink chamber and a standpipe area, wherein the wall defines therein an elongated duct having an outlet opening and an opposite and distal inlet opening, wherein the outlet opening is connected in fluidic communication with the entrained ink chamber, and the inlet opening is connected in fluidic communication with the standpipe area;

a capillary reticulate material that substantially fills the entrained ink chamber, and wherein a void is defined between the capillary reticulate material and the wall, wherein the void is substantially adjacent to the outlet opening; and, a valve supported on the wall and operatively located at the outlet opening, whereby the valve is configured to control fluidic flow between the duct and the entrained ink chamber.

3. The inkjet cartridge of claim 2, and wherein the valve is a one-way valve, whereby fluidic flow is allowed only from the duct to the entrained ink chamber.

4. An inkjet cartridge, comprising a wall that encloses an entrained ink chamber and a standpipe area, wherein:

the wall defines therein an elongated duct having an outlet opening and an opposite and distal inlet opening;

the outlet opening is connected in fluidic communication with the entrained ink chamber;

the inlet opening is connected in fluidic communication with the standpipe area;

the outlet opening of the duct is operatively located above the standpipe area;

the wall further encloses a free ink chamber that is substantially adjacent to the entrained ink chamber;

at least a portion of the duct and the outlet opening thereof are located between the free ink chamber and the entrained ink chamber;

the wall further defines thereon a substantially vertical channel within the entrained ink chamber; and, the channel intersects both the ink port and the outlet opening.

5. An inkjet cartridge comprising:

a wall that defines an entrained ink chamber and a standpipe area, and wherein the wall comprises:

a substantially flat bottom panel, substantially adjacent to which the standpipe area is located;

a substantially flat top panel through which is defined a vent opening and which is spaced apart from, and oriented in substantially parallel juxtaposed relation to, the bottom panel; and, a plurality of substantially flat spaced-apart side panels oriented in substantially parallel juxtaposed relation to one another and extending between, and in substantially normal relation to, the too panel and the bottom panel, whereby the entrained ink chamber is substantially enclosed thereby, and wherein one of the side panels defines therein an elongated substantially vertical duct having an outlet opening and an opposite and distal inlet opening, and wherein the outlet opening is connected in fluidic communication with the entrained ink chamber and is operatively located above the standpipe area, and wherein the inlet opening is connected in fluidic communication with the standpipe area;

the inkjet cartridge further comprising:

a capillary reticulate material that substantially fills the entrained ink chamber, wherein a void is defined between the capillary reticulate material and the wall, and wherein the void is located substantially adjacent to the outlet opening; and, a one-way valve supported on the wall and operatively positioned at the outlet opening, whereby fluidic flow is allowed only from the duct to the entrained ink chamber.

6. An inkjet cartridge, comprising a wall that defines:

a standpipe area;

an entrained ink chamber; and, a free ink chamber, wherein the wall comprises:

a substantially flat bottom panel, substantially adjacent to which the standpipe area is located;

a substantially flat top panel through which is defined a vent opening and which is spaced apart from, and oriented in substantially parallel juxtaposed relation to, the bottom panel; and, a plurality of substantially flat spaced-apart side panels oriented in substantially parallel juxtaposed relation to one another and extending between, and in substantially normal relation to, the top panel and the bottom panel, whereby the entrained ink chamber and the free ink chamber are substantially enclosed thereby; and, a divider panel extending between, and in substantially normal relation to, the top panel and the bottom panel, wherein the divider panel substantially separates the free ink chamber from the entrained ink chamber, and wherein the divider panel defines therein an elongated duct having an outlet opening and an opposite distal inlet opening, and wherein the outlet opening is connected in fluidic communication with the entrained ink chamber and is operatively located above the standpipe area, and wherein the inlet opening is connected in fluidic communication with the standpipe area.

7. The inkjet cartridge of claim 6, and wherein:

the dividing panel defines therethrough an ink port, whereby the entrained ink chamber and the free ink chamber are connected in fluidic communication; and, the outlet opening is operatively located above the ink port.

8. The inkjet cartridge of claim 7, and wherein:

the dividing wall defines thereon an open substantially vertical channel;

the channel is located within the entrained ink chamber; and, the channel substantially intersects both the ink port and the outlet opening.

9. The inkjet cartridge of claim 8, and further comprising a capillary reticulate material that substantially fills the entrained ink chamber and substantially covers the ink port, the channel, and the outlet opening.

* * * * *

UNITED STATES PATENT AND TRADEMARK OFFICE

CERTIFICATE OF CORRECTION

PATENT NO. : 6,955,423 B2
APPLICATION NO. : 10/356774
DATED : October 18, 2005
INVENTOR(S) : Julio A. Rodriquez Mojica et al.

It is certified that error appears in the above-identified patent and that said Letters Patent is hereby corrected as shown below:

IN THE SPECIFICATION

Column 9, line 56, delete “decribe” and insert therefor --described--

IN THE CLAIMS

Claim 5, Column 11, line 13, delete “too” and insert therefore --top--

Signed and Sealed this

Twenty-sixth Day of June, 2007

JON W. DUDAS
*Director of the United States Patent and Trademark Office*